United States Patent [19]

Luchsinger

[11] Patent Number: 4,690,331

[45] Date of Patent: Sep. 1, 1987

[54] SPRAYER AND DIAPHRAGM PUMP THEREFOR

[76] Inventor: Pedro W. Luchsinger, Kilometer 445 of the Panamericana Road, Lagos de Moreno 047400, Jalisco, Mexico

[21] Appl. No.: 848,786

[22] Filed: Apr. 7, 1986

Related U.S. Application Data

[63] Continuation of Ser. No. 616,012, May 31, 1984, abandoned.

[30] Foreign Application Priority Data

Jun. 6, 1983 [MX] Mexico ..... 197539

[51] Int. Cl.[4] ..... B05B 9/043

[52] U.S. Cl. ..... 239/333; 222/385; 417/437

[58] Field of Search ..... 239/333, 355, 362, 373, 239/363; 222/383-385, 175; 92/44, 1, 96, 98, 100, 103 F, 103 M; 417/395, 413, 437

[56] References Cited

U.S. PATENT DOCUMENTS

| | | | |
|---|---|---|---|
| 886,863 | 5/1908 | Riebenack . | |
| 947,536 | 1/1910 | Wenkel . | |
| 983,729 | 2/1911 | Laidley | 417/395 |
| 1,096,463 | 5/1914 | Schorn | 417/560 X |
| 1,429,829 | 9/1922 | Baker . | |
| 1,456,089 | 5/1923 | Baker | 417/566 X |
| 1,659,817 | 2/1928 | Halvorsen . | |
| 1,799,704 | 4/1931 | Riley . | |
| 1,979,135 | 10/1934 | Altenberger et al. | 239/373 X |
| 1,985,282 | 12/1934 | Carter | 103/150 |
| 2,017,145 | 8/1933 | Dunn | 239/373 X |
| 2,139,313 | 12/1938 | Neubauer | 251/119 |
| 2,162,057 | 6/1939 | Brandt et al. | 239/333 X |
| 2,515,568 | 7/1950 | Pharo | 239/373 |
| 2,552,261 | 5/1951 | Coughlin | 417/395 |
| 2,621,971 | 12/1952 | Zoblin | 239/363 X |
| 2,626,185 | 1/1953 | Roselund | 239/333 X |
| 2,786,718 | 3/1957 | Middlestadt | 239/333 X |
| 2,886,011 | 5/1959 | Radford | 92/100 X |
| 2,888,034 | 5/1959 | Glegg | 417/566 X |
| 2,935,248 | 5/1960 | Gerteis | 230/231 |
| 3,034,450 | 5/1962 | Kruckeberg | 92/103 F |
| 3,473,726 | 10/1969 | Bachmann | 230/45 |
| 3,508,849 | 4/1970 | Weber | 417/454 |
| 3,908,520 | 9/1975 | Ma | 92/94 |
| 4,319,570 | 3/1982 | Grane | 417/395 X |
| 4,466,339 | 8/1984 | Huddle | 92/100 |

FOREIGN PATENT DOCUMENTS

| | | | |
|---|---|---|---|
| 480511 | 1/1952 | Canada | 417/560 |
| 260852 | 12/1902 | France | 239/363 |
| 907813 | 7/1945 | France | 239/330 |

*Primary Examiner*—Andres Kashnikow
*Assistant Examiner*—Kevin P. Weldon
*Attorney, Agent, or Firm*—Gausewitz, Carr & Rothenberg

[57] ABSTRACT

A garden sprayer for dispensing pressurized liquids has a pressure vessel mounted within a liquid reservoir container. The pressure vessel carries a diaphragm pump which is detachable as a complete unit and which extends from the container for connection to a pivoted actuating lever that is fulcrumed on the container. The diaphragm, which is directly driven by the pivoted lever, is guided in position and orientation by a guide piston fixed to the diaphragm and slidably guided within the pumping chamber. A pair of input and output check valves, mounted at the end of the pump, permit liquid from the container to be drawn into the pumping chamber and to be forced from the pumping chamber into the pressure vessel. A manually controlled valve on a spray nozzle, which is connected to the pressure vessel, controls pressurized discharge of liquid.

6 Claims, 5 Drawing Figures

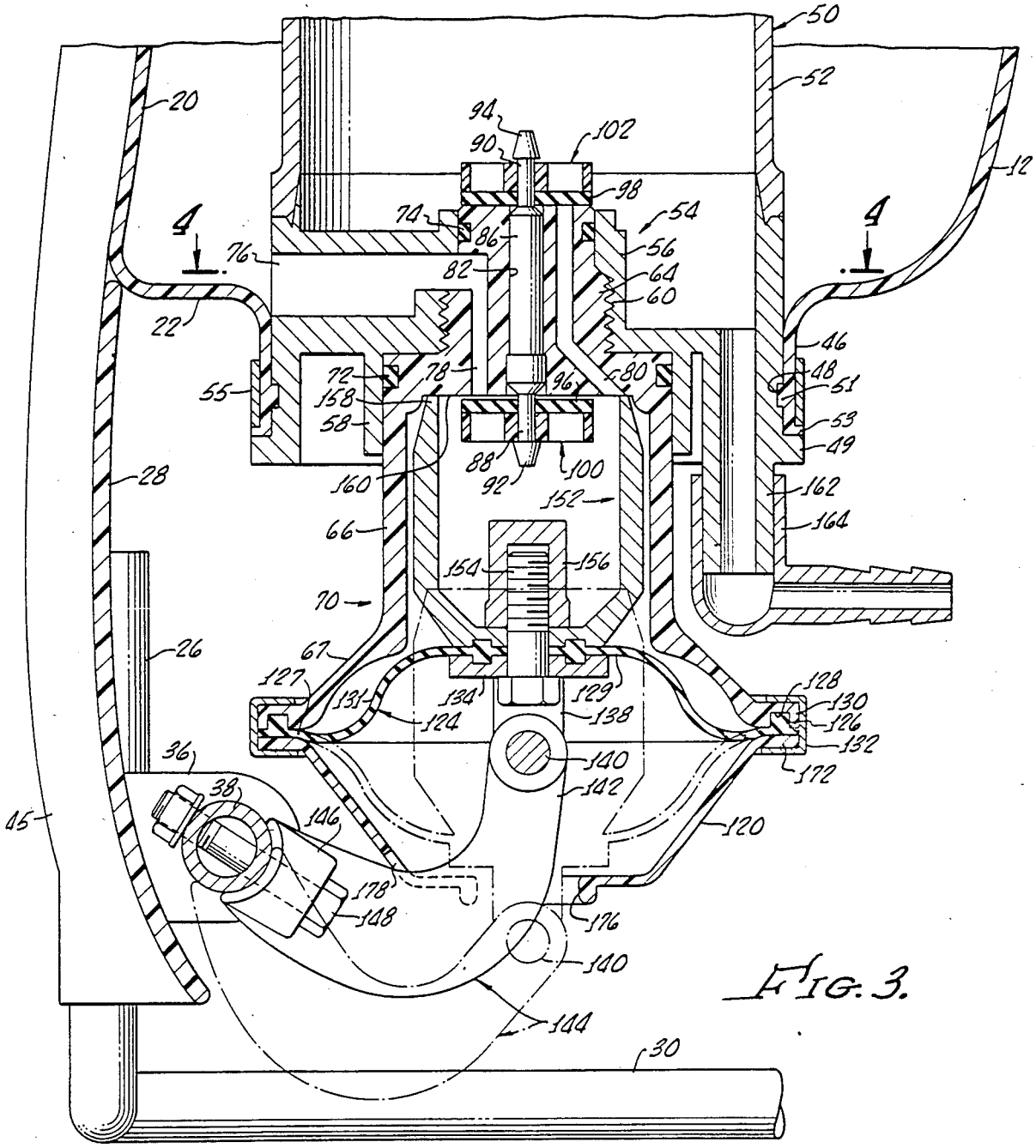
FIG. 3.
FIG. 4.
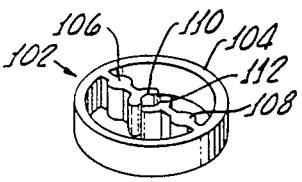
FIG. 5.
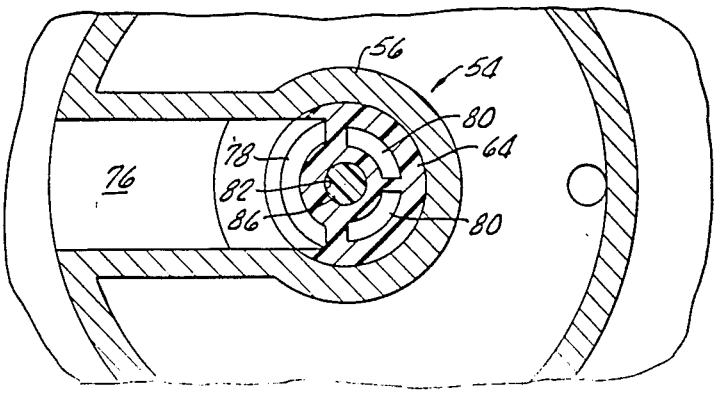

SPRAYER AND DIAPHRAGM PUMP THEREFOR

This application is a continuation of U.S. patent application Ser. No. 606,012, filed May 31, 1984, now abandoned.

BACKGROUND OF THE INVENTION

The present invention relates to garden-type sprayers of pressurized liquids, and more particularly concerns such a sprayer having a diaphragm pump of improved design.

Pressurized discharge of various types of liquid insecticides, fertilizers, and other garden-type treatment liquids, has been accomplished by directly pressurizing a liquid container itself and controlling discharge of liquid from the pressurized container by means of a manually controlled nozzle valve. For all but the smallest of such liquid spraying containers, it is difficult and time consuming to produce sufficient pressure within the relatively large volume of the container as is required for adequate liquid dispensing. The large pressurized volume also makes it more difficult to obtain those higher pressures required for projecting the liquid stream with sufficient power to provide an increased spraying range, or an increased force of impact of the sprayed stream.

In many such prior art sprayers, damage, wear or failure of the pumping mechanism is difficult to repair, and the entire apparatus often must be replaced upon failure of the pump. Piston-type pumping mechanisms are prone to failure and subject to relatively rapid wear, resulting in early loss of pumping power and leakage.

Diaphragm operated pumps have not been applied to garden-type sprayers. Moreover, diaphragm pumps employed in other applications are relatively complex and expensive, are difficult to manufacture and assemble, and require uniquely arranged and complicated linear drive mechanisms.

Accordingly, it is an object of the present invention to provide a diaphragm pump and garden sprayer that avoid or minimize above-mentioned problems.

SUMMARY OF THE INVENTION

In carrying out principles of the present invention, in accordance with a preferred embodiment thereof, a relatively small pressure vessel, which is mounted in a larger liquid container, itself carries a detachably connected pump having a pumping diaphragm that is directly actuated by a pivotal connection to one end of an operating lever journaled upon the liquid container. According to a feature of the invention, the diaphragm is guided in a substantially linear path and with controlled orientation by means of a piston guide that is slidably received in and guided by a portion of the pumping chamber. The piston guide bottoms out against a shoulder in the pumping chamber to thereby limit the pressure stroke of the diaphragm. The mechanical advantage, simplicity and efficiency of directly connected lever operation are provided without the disadvantage of non-linear diaphragm drive.

BRIEF DESCRIPTION OF THE DRAWINGS

FIG. 3 is an enlarged sectional view of the pump and its connection to the pressure vessel and container;

FIG. 4 is a section taken on lines 4—4 of FIG. 3; and

FIG. 5 is a pictorial illustration of a valve disc retainer.

DETAILED DESCRIPTION OF THE PREFERRED EMBODIMENT

Figure 1:
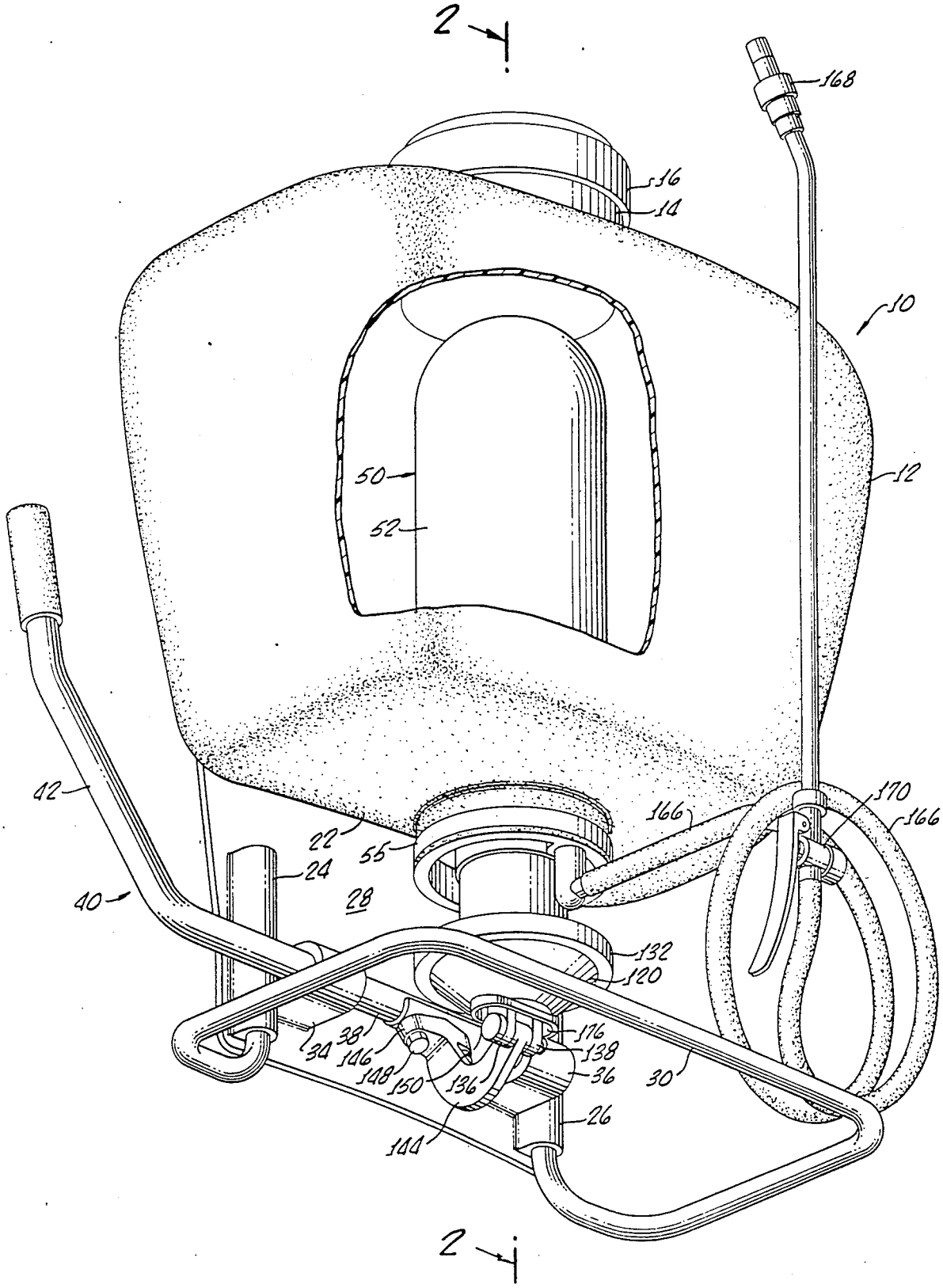
FIG. 1 is a pictorial illustration of a garden sprayer and diaphragm pump embodying principles of the present invention.
Figure 2:
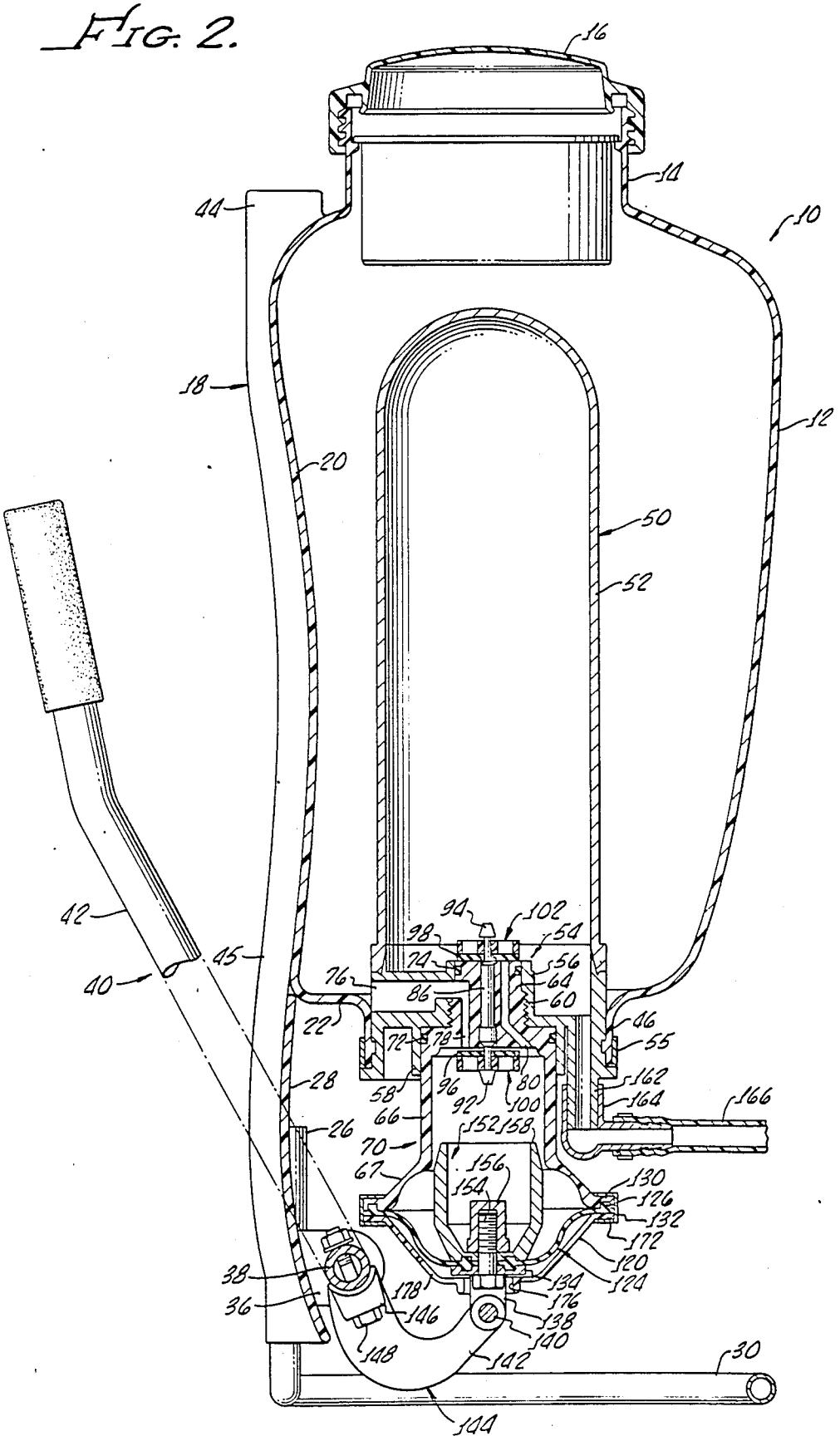
FIG. 2 is a vertical sectional view of the sprayer and pump of FIG. 1.

As shown in FIGS. 1 and 2, a reservoir or container 10 is formed of a plastic body having a fill neck 14 providing an opening that is closed and sealed by a detachable cap 16. A back-supporting panel 18 is fixed to or integrally formed with a forward wall portion 20 of the container and extends downwardly for a significant distance below the bottom 22 of the container. A pair of integral lugs 24, 26 on a lower section 28 of the back panel that extends below the container, are provided with vertical bores that support vertical legs of a tubular stand or container support frame 30. A pair of horizontally spaced, rearwardly extending journal lugs 34, 36, are rigidly fixed to the lower back panel section 28 and extend rearwardly therefrom to pivotally receive the horizontal arm 38 of a substantially L-shaped operating handle 40 having an arm 42 that extends upwardly and forwardly along the back panel 18 at a selected angle thereto. Back panel 18 is formed to snugly fit against the back of a person to whom the container may be secured by means of straps (not shown) suitably fixed to upper and lower portions 44, 45 of the back panel. The forwardly extending handle arm 42, accordingly, may be relatively easily grasped by a person upon whose back the container is supported so that the handle may be pivoted in journal lugs 34, 36 for operation of the sprayer pump, as described below.

The bottom of container 10 is formed with a downwardly extending neck 46, defining an opening in which is mounted the lower portion of a generally cylindrical pressure vessel 50, having an upper section 52 extending upwardly into the interior of the container. The lower end of the pressure vessel 50 is formed with a peripheral groove 48 and a circumferential shoulder 49 to respectively receive an inwardly projecting circumferential locking rib 51 and end flange 53 of the container 10. A suitable, adjustable clamp 55 circumscribes the neck 46 of the container and tightly presses and seals it against the lower end of the pressure vessel.

The lower section of the pressure vessel is formed with a fixed pump receiving fitting, generally indicated at 54, that includes an inner neck section 56 and an outer enlarged neck section 58. Inner neck section 56 is internally threaded as at 60 to detachably receive an externally threaded valve section and connecting fitting 64 formed integrally with and extending from one end of a circular cylindrical housing guide section 66 of a diaphragm pump 70. Housing section 66 is integrally formed with an outwardly flared chamber section 67 that forms an enlarged portion of the pumping chamber of the pump. Section 66 of the pump is tightly received within enlarged outer neck 58 of the pressure vessel and is sealed thereto by means of an O-ring 72. A second O-ring 74 seals an end portion of the pump fitting 64 to the inner neck 56 of the pressure vessel. An input passage 76 extends radially through the lower end of the pressure vessel to communicate at its outer end with the interior of the container 10 and at its inner end with an input passage 78 extending longitudinally through the pump fitting 64 to the interior of the housing guide section 66 of the pump. An output passage 80 extends longitudinally through the pump fitting 64 to connect the interior of the pump housing guide section with the interior of the pressure chamber 50.

A longitudinally extending central bore 82 extends completely through the pump connecting fitting 64 and fixedly mounts a valve pin 86 having inner and outer integral, reduced diameter shaft extensions 88, 90. Each shaft extension has a frustoconical head 92, 94 which retains an assembly of valve disc and disc retainer on the shaft extensions. Thus, on shaft extension 88 is mounted a flexible input valve disc 96 that overlies the inner end of input passage 78 and upon shaft extension 90 is similarly mounted a flexible output valve disc 98 that overlies the outer end of output passage 80. The valve discs are mounted for limited flexing and axial motion of the shafts 88 and 90 and are held in position on the shafts by disc retainers 100, 102, respectively, each of which is retained on its shaft extension by one of the frustoconical heads 92, 94. Each disc, as shown in FIG. 5, includes a ring section 104 having a pair of fixed, resilient, and inwardly directed arms 106, 108 terminating in mating but mutually spaced grooved ends 110, 112 that are adapted to resiliently receive and be retained upon the valve pin extension shaft. The disc retainers are readily assembled upon the shaft by inserting the shaft through the space between the arms 106, 108 and the outer ring 104 and thereafter laterally pressing the shaft into the space between the disc retainer ends 110, 112. Arms 106,108 are sufficiently resilient to allow the flexing necessary to capture the pin shaft between the ends of arms 106, 108. The retainer discs are readily removed by a reversal of the described assembly procedure. With the input and output ports, at the pumping chamber and at the pressure vessel, spaced radially outwardly of the valve pin, the described valve configuration allows expansion of the valve discs upon prolonged immersion without degrading valve performance.

The pump includes a housing cover section 120 in the form of a truncated cone, having a peripheral flange 122. A stiff but resilient diaphragm 124 has a peripheral bead 126 received within a mating groove 128 formed in an outwardly extending flange 130 of the pump chamber section 67. Diaphragm 128 is substantially bell shaped, having its annular edge 127 lying in a central plane that extends between the adjoining flanges of the housing sections. A flat central diaphragm portion 129 lies in a plane displaced from the central plane of the edge and is joined to the edge by an integral dome shaped intermediate portion 131. The intermediate portion flexes and reverses its curvature during pumping action, moving between the solid and dotted line positions shown in FIG. 3, which are spaced from one another by a distance that is a major fraction of the diaphragm radius. This enables the diaphragm to have an extended length stroke and provides an over-the-center snap type action that tends to normally return the diaphragm to and hold it in its outermost position, namely the position of FIG. 2. Linearity of the diaphragm drive (provided as described below) is important for taking advantage of the full extended stroke length without asymmetrical distortion of the reversing diaphragm. Flanges 130 and 122 are clamped to one another and to the interposed diaphragm edge by means of a circular clip 132 that is bent over both flanges to provide a continuous peripheral clamp ring that securely holds the two housing sections and interposed diaphragm in interconnected and sealed relation.

A diaphragm drive includes a rigid circular diaphragm cap 134 having a pair of integrally formed, downwardly projecting and mutually spaced ears 136, 138 (FIG. 1) which are apertured to receive a pivot pin 140 that also extends through an end 142 of an actuating lever 144. Lever 144 is arcuate in shape, being curved through approximately 90°, and is formed with an integral fitting 146 that is bolted to operating handle arm 38 by means of a pair of bolts 148, 150. Thus, the actuating lever 144 is fixedly connected to the handle and forms therewith a single first class lever pivoted to the container about the axis of handle arm 38.

Secured to the inside of the diaphragm 124, opposite the cap 134, is a hollow guide piston 152 of generally circular cylindrical shape. The diaphragm cap and piston are fixedly interconnected with one another and the interposed diaphragm by means of a headed bolt 154 extending through the cap, diaphragm and piston guide into threaded engagement with a closed end retaining nut 156 that is positioned within the hollow piston. The guide piston 152 extends upwardly, well into the pumping chamber defined between the diaphragm and the pump guide and chamber sections 66, 67, and is formed with a cylindrical outer side wall that mates with the cylindrical inner wall of the pump housing section 66. The outer diameter of the piston is slightly less than the inner diameter of the housing section 66 to enable free fluid flow between the piston and housing section. The length of the piston is chosen so that the piston end 158 will contact an inwardly facing shoulder 160, formed in the bottom of the pump housing section 166, to form a stop that limits inward motion of the diaphragm in its pumping or pressure stroke.

The lower end of pressure vessel 50 has an output conduit 162 to which is secured an output fitting 164 that is coupled to a flexible hose 166 having a discharge spray nozzel 168 controlled by a manually operated valve 170 (FIG. 1).

On the suction stroke, the pump diaphragm and guide piston move from the position illustrated in solid lines in FIG. 3. This stroke is accomplished by clockwise (as viewed in FIG. 2) pivoting of the handle 42, 38 and the actuating lever 144 fixed thereto. The handle and lever are pivoted about the axis of arm 138 to cause pivot pin 140 to move in an arcuate path to the position illustrated in FIG. 2. In this position the diaphragm cap 134 is closely adjacent to or bears against the inner side of the top of housing cover section 120 with the yoke ears 136, 138 of the cap extending through an elongated aperture 176 formed in the housing cover section. The cover section may be slotted, if deemed necessary or desirable, as indicated at 178, to receive the inner curved portion of the actuating lever 144 in the limit of its pumping stroke.

With the actuator in its extreme clockwise position (as shown in FIG. 2), and the diaphragm cap at or against the pump housing cover, the free end of the piston guide extends a slight distance into the housing guide section so as to ensure that the piston guide is maintained within the housing guide section at all times. Furthermore, the free end of the piston guide is tapered to facilitate entry of the piston guide into the housing guide section during assembly.

During this suction stroke, powered by the clockwise pivoting of the actuator lever and handle, liquid is drawn from the interior of the container 10, through the input passage 76, 78, into the pumping chamber. The decreased pressure within the pumping chamber shifts valve disc 96 downwardly along shaft 88 to a limit position defined by the disc retainer 100, thereby opening the input passage 78 to the pumping chamber. Pressure within the vessel 50 and the decreased pressure within the pumping chamber concomitantly act to urge the valve disc 98 against the end of the pump fitting 64 to thereby block and seal the output passage 80.

For the pumping stroke, handle 38, 42 and actuating lever 144 are pivoted in a counterclockwise direction (as viewed in FIGS. 2 and 3) to thereby drive the diaphragm and piston inwardly. A large mechanical advantage, provided by the long handle arm 42 and much shorter lever 144, enables high pressure to be generated in the pressure vessel by application of relatively small force. The pivotally mounted actuating lever 144 is directly connected to the diaphragm by means of the diaphragm fixed yoke arms 136, 138, thereby simplifying construction, enabling a more compact configuration, and providing improved and more direct application of driving force to the diaphragm. However, because of this direct connection, the pivot pin 140 moves in an arcuate path during pumping and suction strokes, thereby tending to distort the diaphragm and tending to cause the diaphragm to bend asymmetrically. Such distortion or asymmetrical bending of the diaphragm, which tends to increase because of the extended length stroke, tends to tilt the piston guide relative to the axis of the pump. However, because of the fit between the piston and the guide section of the pump housing, both lateral displacement and tilting of the piston guide are limited. The fixed interconnection of the piston guide and diaphragm, therefore, limits the distorted asymmetrical bending of the diaphragm. It is to be noted that there is sufficient space between the outer side of the guide piston and the inner wall of the housing section 66 to provide fluid communication between portions of the pumping chamber within the hollow cylindrical guide and outside of the hollow cylindrical guide. Motion of both the diaphragm and the piston guide act upon the confined liquid to provide the suction and pumping forces exerted on the liquid during operation of the pump. Engagement of the free end 158 of the guide piston with the stop surface 160 of the housing section 66 provides a positive motion-limiting stop for the diaphragm during its pumping stroke. The valve discs are effective to seal and unseal the input and output passages of the pump, regardless of dimensional changes of the discs that may result from exposure to various types of liquid environments.

The described diaphragm pump is leak free for long periods of use, provides an effective, simple, and highly efficient diaphragm drive mechanism, limiting undesired distortional bending of the diaphragm.

The sprayer is a readily assembled combination of its major components. The pump, as a complete unit, is readily assembled to and disassembled from the pressure vessel merely by disconnecting the actuating lever from the drive yoke 138, 136 and unscrewing the pump housing from the reservoir. Similarly, the reservoir itself may be readily removed, merely by removing the clamp 59 and resiliently spreading the lower neck 46 of the outer container. The pump housing sections themselves are readily assembled, together with the interposed diaphragm, by means of the continuous peripheral clamping ring 132. The diaphragm pump is more durable and less susceptible to leakage, at least partly because there are no moving seals to wear out. With both input and output passages and valving at one end of the pumping chamber, an improved and simplified disc valve structure is provided. The valving is efficient, reliable, and durable, yet is simple and inexpensive to manufacture.

The foregoing detailed description is to be clearly understood as given by way of illustration and example only, the spirit and scope of this invention being limited solely by the appended claims.

What is claimed is:

1. A manually operated sprayer for dispensing liquid insecticides, herbicides or pesticides comprising a liquid container having a first sealable opening for receiving liquid to be dispensed from the container, and having a second opening, a pressure vessel mounted within said container and sealed to said second opening, said pressure vessel having an internally threaded pump-receiving fitting communicating with the interior thereof and with said container, said pressure vessel having a discharge fitting providing communication between the interior thereof and ambient atmosphere, a pump housing having a generally cylindrical section and having a connecting section coaxial with said generally cylindrical section and detachably secured and sealed to said pump-receiving fitting of said pressure vessel, a downwardly and outwardly flared chamber section integral with said cylindrical section at an end remote from said connecting section and having an outwardly extending peripheral flange, a cover section having an outwardly extending peripheral cover flange, a peripheral groove formed in one of said flanges, a stiff but resilient generally bell shaped diaphragm having a peripheral edge thereof secured to and between said flanges and having a normal inverted orientation for forming a liquid receiving pumping chamber within said pump housing between said diaphragm and said connecting section, said diaphragm having a flat central portion lying in a plane displaced from the plane of said diaphragm peripheral edge and connected to said diaphragm peripheral edge by an integral dome shaped intermediate portion, whereby the central portion moves between extreme positions that are spaced from one another by a distance that is a major fraction of the diaphragm radius, and whereby the intermediate portion flexes and reverses its curvature during pumping action, and whereby the stiff but resilient diaphragm provides an over-the-center snap type action that tends to return the diaphragm to hold it in its normally inverted orientation, said diaphragm having a peripheral bead received in said peripheral groove, a continuous peripheral clamping ring extending around and over both said flanges and clamping said flanges and the interposed diaphragm edge therebetween to thereby securely hold said flanges and interposed diaphragm in interconnected and sealed relation, said clamping ring, flanges and diaphragm peripheral edge being free of fastening apertures, a rigid circular diaphragm cap on said diaphragm adjacent said cover section, an actuating lever pivotally mounted to said container and having an end pivoted directly to said diaphragm cap whereby at least portions of the diaphragm are driven in an arcuate path during said pumping and suction strokes, thereby tending to distort the diaphragm and tending to cause it to bend asymmetrically, said cylindrical housing section including a cylindrical guide section, a hollow guide piston having a closed end and having a diameter slightly less than the diameter of said cylindrical guide section, said hollow guide piston extending from said diaphragm into sliding and guiding engagement with the interior of said cylindrical guide section, said hollow guide piston having at least an end portion thereof positioned within said guide section during all positions assumed by the diaphragm during said pumping and suction strokes, fastener means having an end contained within said hollow piston and extending through said closed end and through said diaphragm for holding said hollow piston and said diaphragm cap rigidly clamped together with said central diaphragm portion interposed therebetween, whereby only said dome shaped intermediate diaphragm section bends during said pumping and suction strokes, and valve means in said connecting section and one end of said guide section for controlling flow to and from said pumping chamber.

2. The sprayer of claim 1 wherein said connecting section comprises a valve fitting section on an end of said pump housing remote from said cover section, said valve fitting section having a diameter less than the diameter of said pump housing cylindrical section and being externally threaded, an output conduit extending longitudinally through said valve fitting section from the interior of said housing section to a pump output port and to an end of said valve fitting section, an input port formed in a side of said valve fitting section, an input conduit extending longitudinally through a part of said valve fitting section from the interior of said housing section to said input port, said valve fitting section having a longitudinally extending bore, said valve means comprising a valve pin fixed in said bore and having first and second extension shafts extending from opposite ends thereof, a first flexible valve disc on said first shaft within said housing section and overlying said input conduit for blocking and unblocking said input conduit, a first retainer on said first extension shaft for limiting motion of said valve disc from said input conduit, means for securing said first retainer to said first extension shaft, a second valve disc on said second extension shaft positioned to block and unblock said output conduit means, a second retainer on said second extension shaft positioned to limit motion of said second valve disc from said output output conduit, and means on said second extension shaft for holding said second retainer thereon.

3. The sprayer of claim 2 wherein said cylindrical guide section includes stop means facing said piston for contacting said end portion of said piston to stop motion of said piston and diaphragm during a pumping stroke at a limit position, and wherein said piston end portion has an internal diameter greater than the diameters of said first mentioned valve disc and said first retainer, and wherein said first mentioned valve disc and said first retainer extend into said piston end portion at said limit position.

4. A manually operated agricultural sprayer for dispensing herbicides, insecticides, pesticides and the like, and being adapted for use by positioning in a vertical position, said sprayer comprising a. a liquid container having a first sealable opening adjacent the top thereof for receiving liquid to be dispensed from the container, and having a second opening adjacent the bottom thereof, b. a pressure vessel mounted within said container and sealed to said second opening, said pressure vessel having (i) a discharge fitting providing communication between the interior thereof and ambient atmosphere, and (ii) a pump-receiving fitting portion with a generally circular aperture extending therethrough communicating with the interior of said pressure vessel, said fitting portion having liquid passage means communicating with said aperture and the interior of said liquid container, a separable pump assembly having (i) a housing having a generally cylindrical portion and a connecting portion coaxial with the cylindrical portion and configured for being matingly received within said aperture of said pump-receiving fitting portion for detachably securing and sealing said assembly to said pressure vessel within said pump-receiving fitting portion, (ii) a stiff but resilient generally bell-shaped diaphragm having a peripheral edge thereof secured to said housing and having a normal inverted orientation for forming a liquid receiving pumping chamber within said housing between the surface of said diaphragm and said connecting portion, said diaphragm having a flat central portion lying in a plane displaced from the plane of said peripheral edge and connected to said peripheral edge by an integral dome shaped intermediate portion, whereby the intermediate portion flexes and reverses its curvature during pumping action, whereby the central portion can move between extreme positions that are spaced from one another by a distance that is a major fraction of the diaphragm radius, and whereby the diaphragm provides an over-the-center snap type action that tends to normally return the diaphragm to and hold it in its normal inverted orientation, (iii) guide means affixed to said diaphragm central portion on a side thereof adjacent said cylindrical portion of said housing for interengagement with said cylindrical housing portion for controlling orientation and limiting lateral displacement of said diaphragm during actuation thereof, (iv) said connecting portion including an axially aligned bore with first and second conduit means extending along and adjacent thereto, said first conduit means communicating with said liquid passage means of said fitting portion and said second conduit means providing flow communication between said pumping chamber and the interior of said pressure vessel, and (v) valve means including a valve pin fixed in and extending through said bore with first axially movable valve closure means attached to one end thereof for coaction with said first conduit means and second axially movable valve closure means attached to the other end thereof for coaction with said second conduit means, d. an actuating lever pivoted to said container, e. means for pivotally connecting said actuating lever to said diaphragm, and f. means for pivoting said actuating lever for operating said diaphragm from its normal orientation through a pumping stroke, with return thereof through a suction stroke assisted in part by the resilience of said diaphragm, with said first and second valve closure means operable thereby for selectively blocking one of said first and second conduit means and simultaneously unblocking the other of said first and second conduit means.

5. The combination according to claim 4 wherein said guide means includes a generally hollow guide piston having a closed end and being loosely slidably received within said cylindrical portion of said housing for controlling movement of said diaphragm during operation of said actuating lever while enabling the passage of liquid through said cylindrical housing portion and said conduit means about the periphery of said piston, said guide piston having a tapered end remote from said diaphragm and having at least said tapered end received within said cylindrical portion of said housing throughout said pumping and suction strokes, a fastener and fastener retainer affixing said hollow guide piston to said diaphragm, said fastener extending through said diaphragm and through said closed end of said piston, said fastener retainer being positioned entirely within said hollow guide piston and fixed to said fastener to secure said piston to said diaphragm.

6. The sprayer of claim 5 wherein said generally cylindrical portion of said housing has a stop surface facing said piston and positioned to abut an end of said piston remote from said closed end to limit motion of said diaphragm during a pumping stroke.

* * * * *